US006156169A

United States Patent [19]

Yang et al.

[11] Patent Number: 6,156,169

[45] Date of Patent: Dec. 5, 2000

[54] ELECTROPLATING ANODE TITANIUM BASKET

[75] Inventors: Chin-Chang Yang; Sheng-Hsiung Chang, both of Taichung Hsien, Taiwan

[73] Assignees: Jyu Lenq Enterprises Co., Ltd.; Chu Li Enterprises Co. Ltd., both of Taichung Hsien, Taiwan

[21] Appl. No.: 09/412,612

[22] Filed: Oct. 6, 1999

[51] Int. Cl.[7] ..... C25B 11/00

[52] U.S. Cl. ..... 204/280; 204/285; 204/287; 204/259; 204/297.01; 204/297.06; 204/297.11; 204/297.12

[58] Field of Search ..... 204/280, 285, 204/287, 259, 297.01, 297.06, 297.11, 297.12

[56] References Cited

U.S. PATENT DOCUMENTS

| | | | |
|---|---|---|---|
| 4,059,493 | 11/1977 | Rice | 204/280 |
| 4,328,076 | 5/1982 | Fisher et al. | 204/279 |
| 4,569,744 | 2/1986 | Walker | 204/287 |
| 4,714,535 | 12/1987 | Coombes et al. | 204/297.01 |
| 5,620,586 | 4/1997 | Claessens et al. | 204/259 |
| 5,744,013 | 4/1998 | Botts et al. | 204/285 |
| 5,766,430 | 6/1998 | Mehler | 204/280 |
| 5,776,327 | 7/1998 | Botts et al. | 205/96 |
| 5,938,899 | 8/1999 | Forand | 204/280 |

*Primary Examiner*—Bruce F. Bell
*Attorney, Agent, or Firm*—Rosenberg, Klein & Lee

[57] ABSTRACT

An electroplating anode titanium basket including a fixing section, a resolution section and a surrounding section. The surrounding section can effectively increase the area of the insoluble anode and enhance the load ability of the anode. The increased area of the soluble anode can effectively work without quickly increasing the concentration of the electroplating bath. The supplier is resolved on the face opposite to the work piece so that the effective resolution of the supplier is enhanced to truly increase the production ability of the electroplating operation. In addition, the supplier is prevented from being stuck so that the supplementation of the supplier is facilitated and the using effect is improved.

7 Claims, 6 Drawing Sheets

PRTOR ART

ELECTROPLATING ANODE TITANIUM BASKET

BACKGROUND OF THE INVENTION

The present invention relates to an electroplating anode titanium basket including a surrounding section which is able to increase the production ability and facilitate supplementation of the supplier.

As shown in FIG. 7, in existing electroplating operation, an electroplating bath 81, a titanium basket 82 and a work piece 83 are placed in an electrolytic tank 8. The titanium basket 82 is mostly made of titanium which is electrically conductive without being electrolyzed. A metal supplier 821 which can be electrolyzed to provide cation is placed in the titanium basket 82. The supplier 821 is electrically connected with the anode, while the work piece 83, which is to be supplied, is electrically connected with the cathode. By means of the electrolysis of the anode, the supplier 821 is coated onto the work piece 83 to form an electroplating coating so as to achieve anti-rusting effect. During the electroplating operation, it is necessary to supplement the supplier 821 in the titanium basket 82 in proper time.

FIGS. 8 and 9 show an existing anode titanium basket which is composed of two sheets of meshes 84. The mesh 84 is made of multiple metal wires 85, 86 which are bent into wave shape. The wave crest 851 of one metal wire 85 intersects and connects with the wave hollow 861 of the other metal wire 86. Accordingly, the adjoining sections of the wave crest 851 and the wave hollow 861 will have a thickness twice the diameter of the metal wires 85, 86 as shown in FIG. 10. A number of such sections with uneven thickness will be distributed over the surface of the mesh 84 and the surface will have multiple transversely projecting sections 87. When the supplier 821 is placed into the anode titanium basket 82, the supplier 821 tends to be stuck by the projecting sections 87 or stopped by the intersecting sections of the metal wires 85. In the electroplating operation, the supplier 821 is continuously electrolyzed to the cathode so that it is necessary to supplement the supplier 821. The titanium basket 82 is not taken out of the electroplating bath 81 and it is directly observed from the upper side of the bath level whether the supplier 821 in the elongated titanium basket 82 immersed in the bath 81 is sufficient. However, the supplier 821 will be stuck by the mesh 84. As a result, although it is observed from the upper layer of the titanium basket 82 that there is still sufficient supplier 821, in fact, the bottom or other lower positions of the titanium basket 82 have already lacked supplier 821. Therefore, it often takes place that the top section of the work piece has an electroplating coating, while the bottom section of the work piece has no electroplating coating.

Another type of mesh 91 of the existing anode titanium basket 9 is formed by multiple longitudinal metal wires 92. The surface of the mesh 91 is free from projecting sections with uneven thickness so that the supplier 821 will not be stuck and there will be no uneven electroplating coating of the work piece.

However, the existing titanium baskets 82, 9 both have the following problem: The surface area of the supplier 821, that is, the area of the soluble anode, will affect the efficiency of the electroplating. The current load of the cathode is better than that of the anode and is proportional to the electroplating efficiency as the area of the soluble anode. Therefore, the supplier 821 is made with circular shape or crown-shape with larger surface area (as shown in FIG. 11 ). In actual use, such supplier 821 with larger surface area can increase the area of the soluble anode. However, the electroplating efficiency can be only slightly enhanced. Moreover, the supplier 821 is resolved from both the front and rear sides of the titanium basket 9. With insufficient area of the insoluble anode, the concentration of the electroplating bath 81, such as the concentration of nickel sulfate in nickel electroplating tank and the concentration of cupric sulfate in copper electroplating tank, will be quickly increased to exceed the standard value. This will lead to the following affections:

1. The stress of the electroplating coating is increased to make the electroplating coating cracky.
2. The crystal granule of the electroplating coating is large and the plainness of the electroplating coating is poor. These lead to poor anticorrosion ability.
3. The resistance of the electroplating coating is increased to make uneven the distribution of high and low current efficiency of the respective parts of the work piece. This leads to poor unification of the electroplating coating.

Therefore, the increment of the concentration of the electroplating bath 81 will result in many ill affections in the electroplating operation. The concentration of the electroplating bath 81 is quickly increased so that it is necessary to discard a part of the electroplating bath 81 in short time. The remaining electroplating bath is diluted for further use. The discarded electroplating bath will seriously affect the environment and can be hardly treated. This leads to environmental pollution problem. Therefore, the circular or crown-shaped supplier 821 with larger surface area will result in quick increment of the concentration of the electroplating bath 81 and is not preferred.

SUMMARY OF THE INVENTION

It is therefore a primary object of the present invention to provide an electroplating anode titanium basket including a surrounding section which stops the rear side OF the titanium basket to achieve a shielding effect. The surrounding section also effectively increases the current efficiency and the area of the insoluble anode and enhance the load ability of the anode. The increased area of the soluble anode can effectively work without quickly increasing the concentration of the electroplating bath. The supplier is resolved on the face opposite to the work piece so that the effective resolution of the supplier is enhanced to truly increase the production ability of the electroplating operation and improve the using effect.

The present invention can be best understood through the following description and accompanying drawings wherein:

DETAILED DESCRIPTION OF THE PREFERRED EMBODIMENTS

Figure 1:
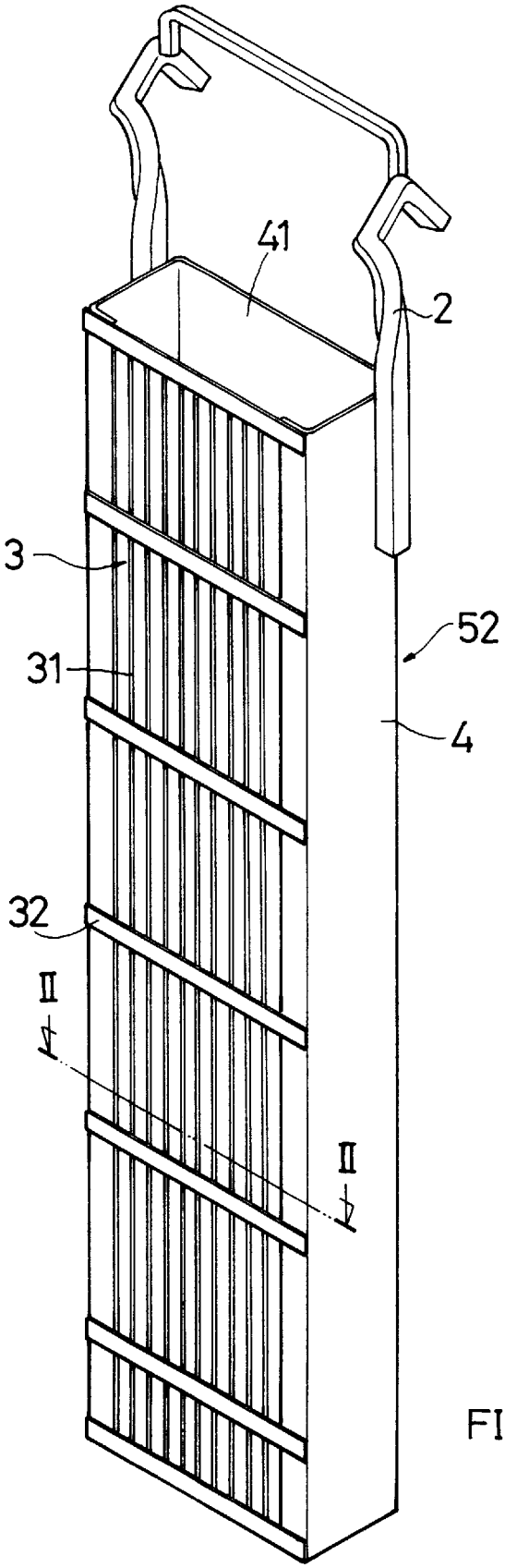
FIG. 1 is a perspective view of the present invention.
Figure 2:
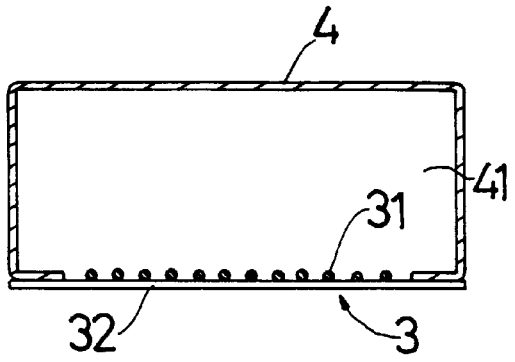
FIG. 2 is a sectional view taken along line II—II of FIG. 1.

Please refer to FIGS. 1 to 4. The electroplating anode titanium basket 52 of the present invention includes:

a fixing section 2 for locating the anode titanium basket 52 at the anode of an electroplating tank 5, in this embodiment, the fixing section 2 is a hook;

a resolution section 3 formed by multiple longitudinal metal wires 31 which will not stick with the cation metal supplier 521 and facilitates supplementation of the supplier 521, the metal wires 31 being disposed with multiple reinforcing strips 32; and a surrounding section 4 which is a panel disposed on rear side of the resolution section 3, two lateral sides of the surrounding section 4 being connected with two lateral sides of the resolution section 3, whereby the surrounding section 4 and the resolution section 3 together define a receiving chamber 41. The surrounding section 4 seals the rear side of the receiving chamber 41 and has an area larger than that of the resolution section 3. In this embodiment, the surrounding section 4 and the resolution section 3 are both substantially rectangular. Two lateral sides and back side of the resolution section 3 are all enclosed by the surrounding section 4. The fixing section 2, surrounding section 4 and the resolution section 3 are all made of titanium.

Figure 3:
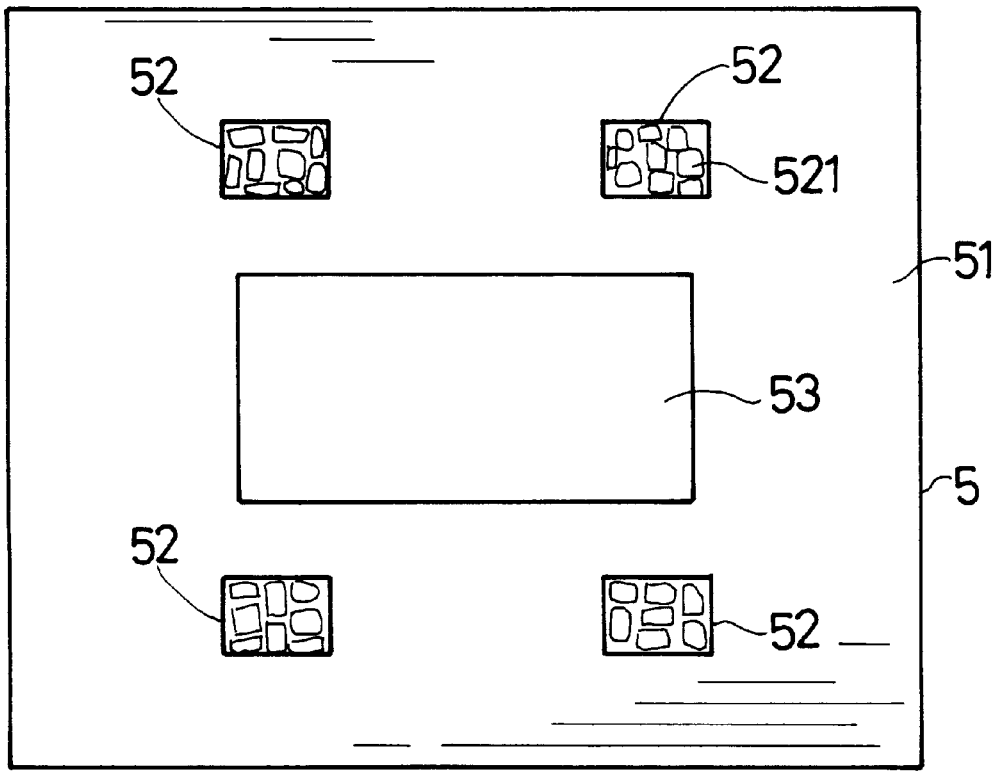
FIG. 3 shows the application of the present invention in one state.
Figure 4:
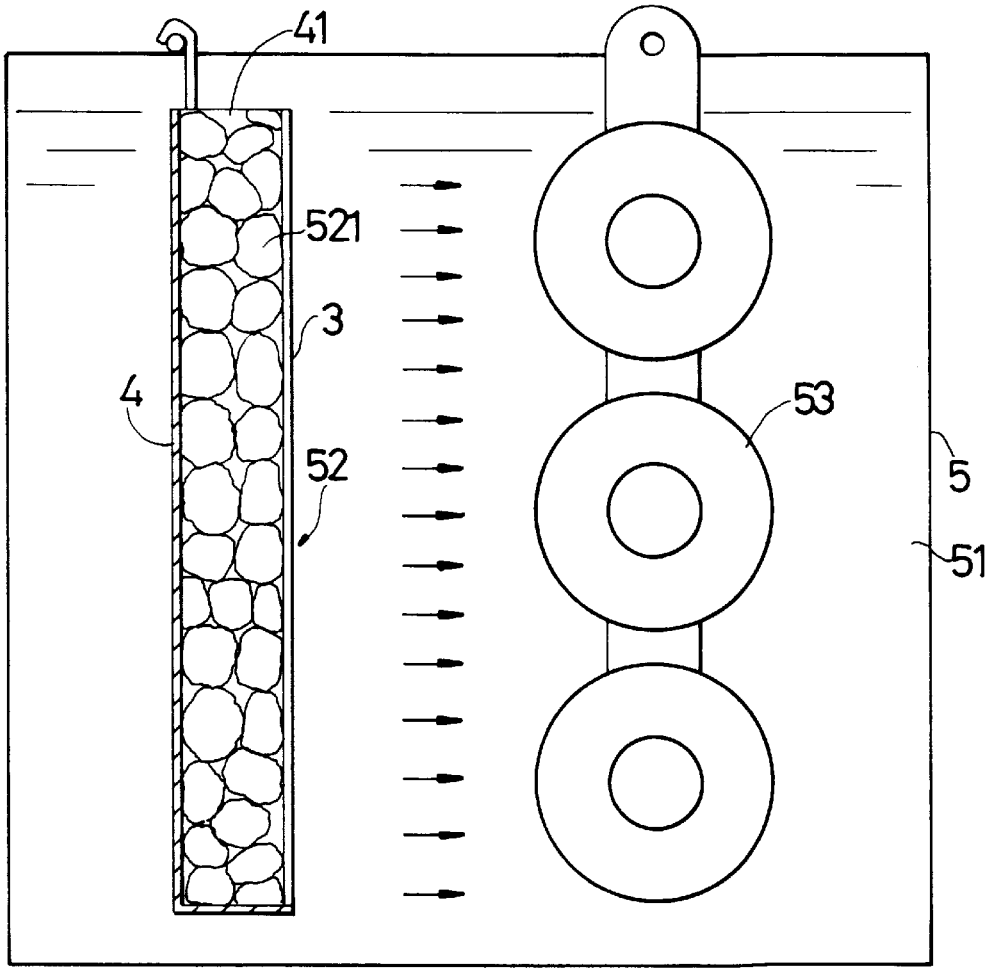
FIG. 4 shows the application of the present invention in another state.

As shown in FIGS. 3 and 4, in electroplating operation, the electroplating bath 51, titanium basket 52 and the work piece 53 are placed into the electroplating tank 5. The supplier 521 is positioned in the titanium basket 52 which is electrically connected with the anode. The work piece 53 which is to be electroplated is electrically connected with the cathode. By means of the electrolysis of the anode, the work piece 53 is coated with the supplier 521 to form an electroplating coating.

The resolution section 3 is made of multiple longitudinal metal wires 31 without any projection having uneven thickness on the surface so that the supplier 521 will not stick with the resolution section 3 and the uneven electroplating coating on the work piece 53 can be avoided. In addition, the surrounding section 4 increases the total surface area of the titanium basket 52 so as to enlarge the area of the insoluble anode and enhance the load ability of the anode. That is, under constant electroplating voltage, the internal current is increased to shorten the electroplating time. Reversely, under constant current, the voltage can be lowered so as to save cost.

The production ability of the electroplating is related to the surface area of the supplier 521, that is, the area of the soluable anode will affect the electroplating efficiency. In addition, the insoluble anode area of the anode titanium basket 52 is a more major factor affecting whether the resolved supplier can successfully attach to the work piece. The area of the insoluble anode serves as a bridge between the supplier 521 and the work piece 53. Only in the case that the insoluble anode area is sufficient, the increased soluble anode area can effectively work to make the resolved supplier 521 attach to the work piece 53. Otherwise, the supplier 521 will be only resolved into the electroplating bath 51 to waste the supplier 521 and quickly increase the concentration of the electroplating bath 51. The surrounding section 4 of the present invention effectively increases the area of the insoluble anode and provides an effective bridge between the supplier 521 and the work piece 53, whereby the increased soluble anode area can effective work and truly increase the production ability of the electroplating operation. Therefore, it is possible to use those suppliers 521 with larger surface area such as crown-shaped supplier 521 without quickly increasing the concentration of the electroplating bath 521.

In addition, as shown in FIG. 4, in electroplating operation, most of the effectively resolved supplier 521 is concentrated on the face opposite to the work piece 53, that is, the resolution section 3. The surrounding section 4 serves to stop the rear side of the titanium basket 52 to achieve a shielding effect and make the resolved supplier 521 concentrate on the face opposite to the work piece 53. The rear side of the titanium basket 52 is stopped by the surrounding section 4 so that the rear side of the titanium basket 52 is free from anion and the concentration of the electroplating bath will not increase and the supplier 521 can be effectively resolved to increase the production ability. In the case that the number of the titanium basket 52 is increased, the electroplating time can be shortened, while achieving the same thickness of the electroplating coating. In addition, the distribution of the high and low current efficiency of the respective parts of the work piece is even and the electroplating coating has good unification.

Figure 5:
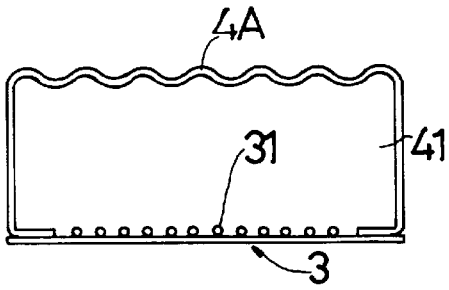
FIG. 5 is a plane view of a second embodiment of the present invention.
Figure 6:
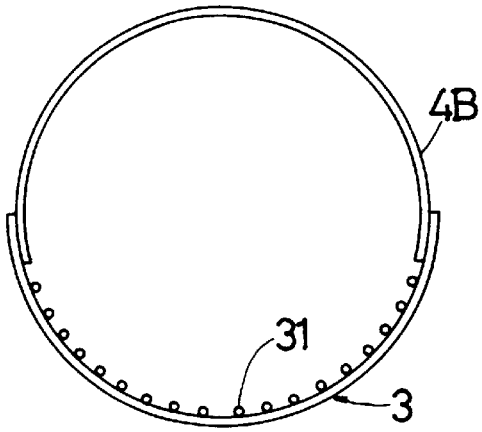
FIG. 6 is a plane view of a third embodiment of the present invention.
Figure 7:
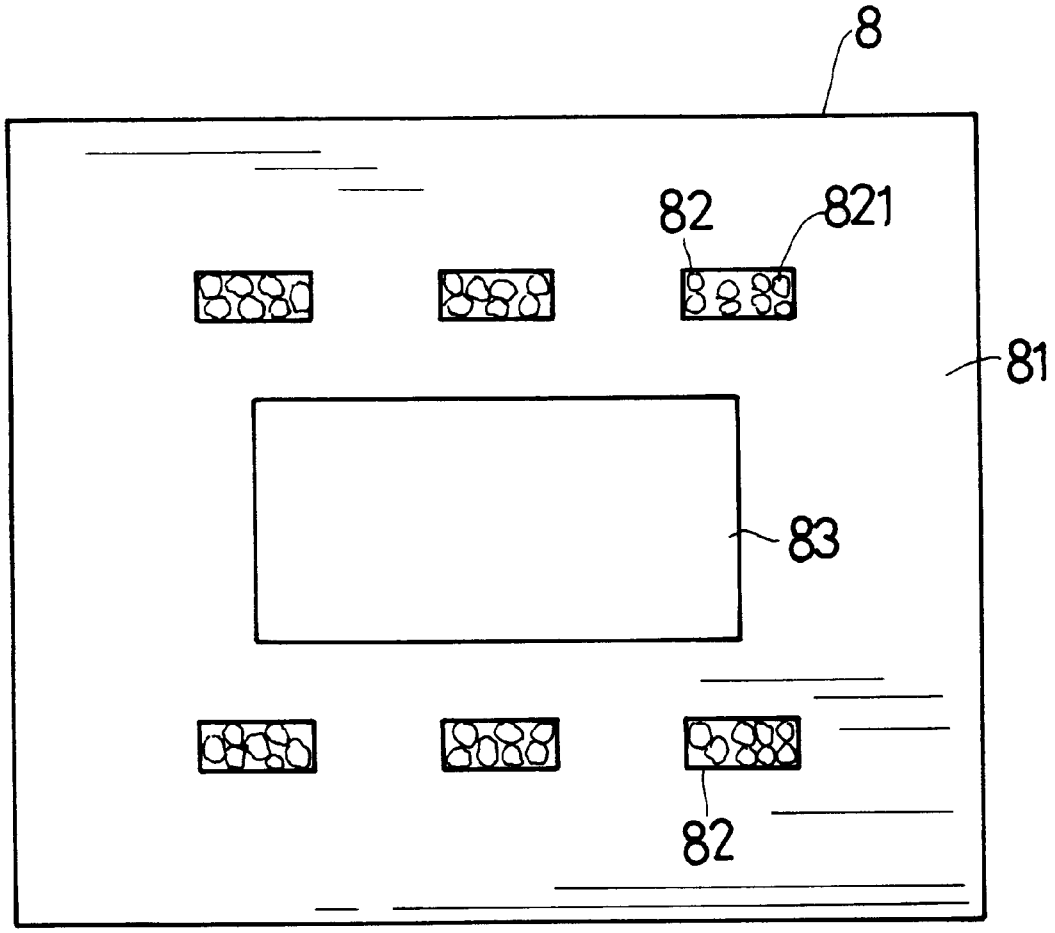
FIG. 7 shows the application of a conventional electroplating anode titanium basket.
Figure 8:
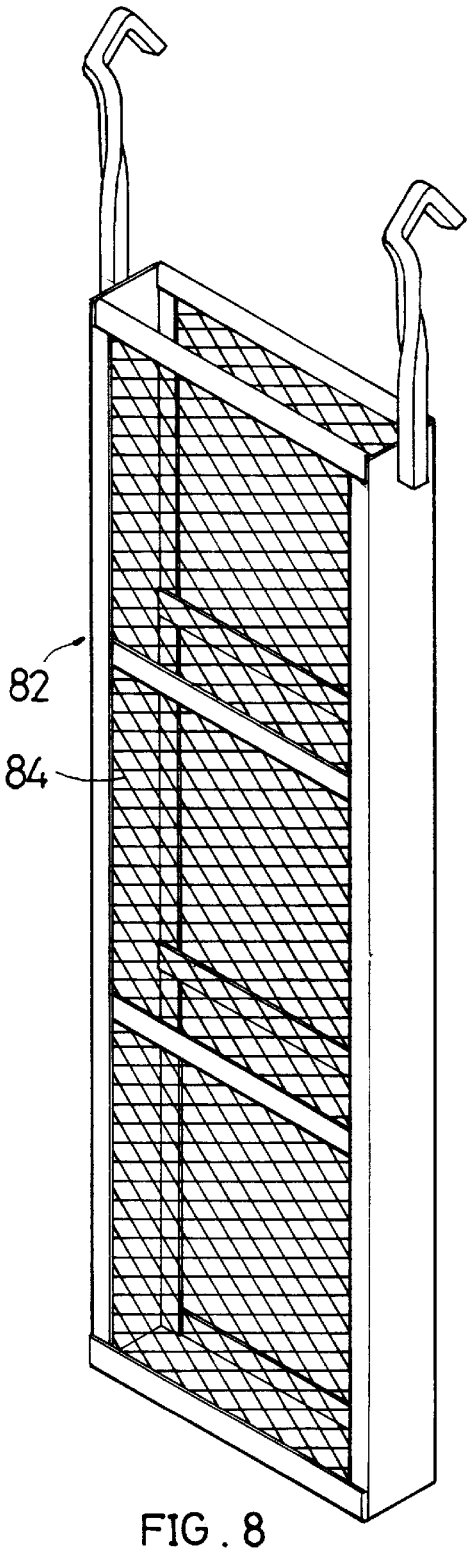
FIG. 8 PRIOR ART
FIG. 8 is a perspective view of a first conventional electroplating anode titanium basket.
Figure 10:
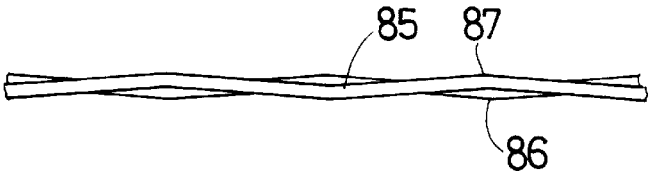
FIG 10 PRIOR ART
FIG. 10 is a top view of the mesh of the first conventional electroplating anode titanium basket.
Figure 9:
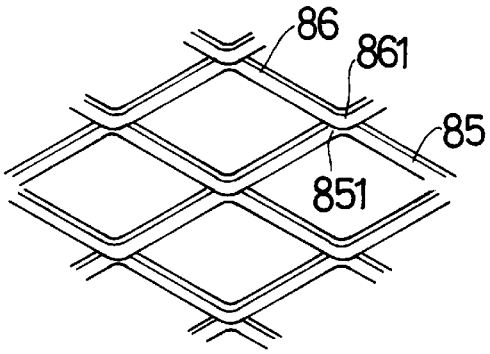
FIG. 9 PRIOR ART
FIG. 9 is an enlarged view of the mesh of the first conventional electroplating anode titanium basket.
Figure 11:
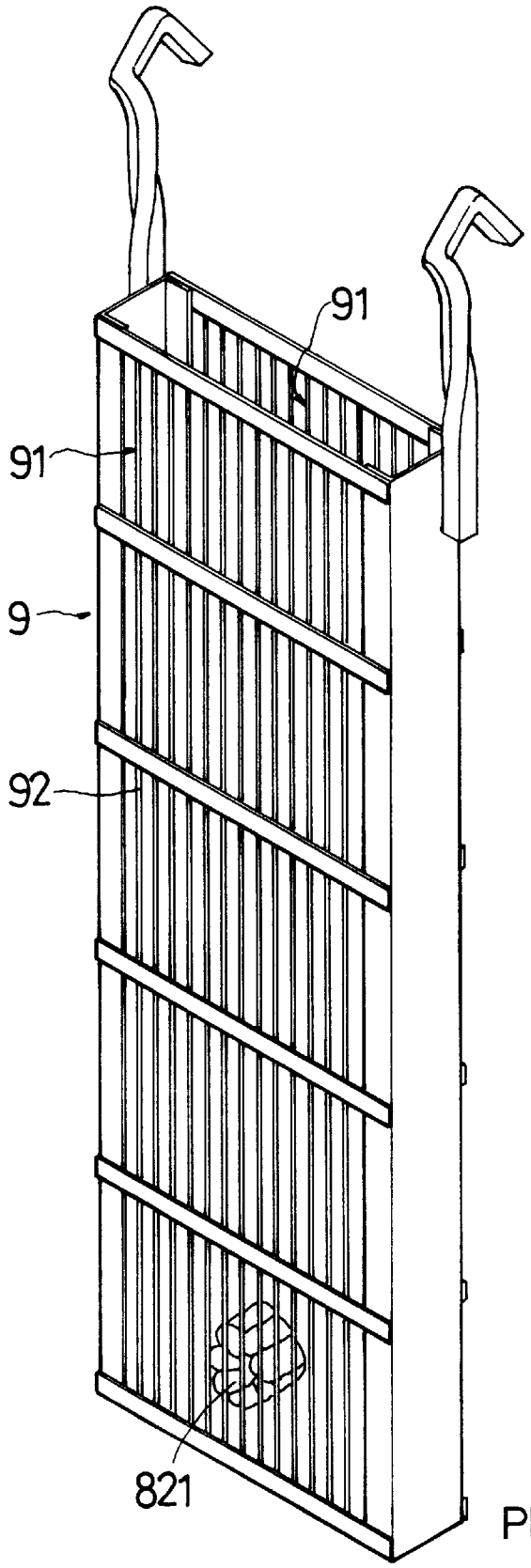
FIG .11 PRIOR ART
FIG. 11 is a perspective view of a second conventional electroplating anode titanium basket.

FIG. 5 shows a second embodiment of the present invention, in which the surrounding section 4A is a waved board which not only prevents the supplier 521 from being stuck, but also increases the area of the insoluble anode more than the first embodiment. The metal wires 31 of the resolution section 3 can intersect each other to form a mesh. Furthermore, as shown in FIG. 6, the resolution section 3 and the surrounding section 4B are bent with a curvature to achieve the same effect as the above.

In conclusion, the surrounding section 4 of the titanium basket of the present invention is able to effectively increase the area of the insoluble anode and enhance the load ability of the anode and save cost. Therefore, the increased area of the soluble anode can effectively work without quickly increasing the concentration of the electroplating bath 51. The supplier 521 is resolved on the face opposite to the work piece 53 so that the effective resolution of the supplier 521 is enhanced to truly increase the production ability of the electroplating operation and improve the using effect.

The above embodiments are only used to illustrate the present invention, not intended to limit the scope thereof. Many modifications of the above embodiments can be made without departing from the spirit of the present invention.

What is claimed is:

1. An electroplating anode titanium basket comprising:

a fixing section for locating the anode titanium basket in an electroplating tank;

a resolution section made of multiple metal wires; and a surrounding section disposed on rear side of the resolution section, the surrounding section and the resolution section together defining a receiving chamber, the fixing section, surrounding section and the resolution section being all made of titanium, said anode titanium basket being characterized in that the surrounding section is a panel, two lateral sides of the surrounding section being connected with two lateral sides of the resolution section, the surrounding section sealing the rear side of the receiving chamber and having an area larger than that of the resolution section.

2. An electroplating anode titanium basket as claimed in claim 1, wherein the surrounding section and the resolution section are both substantially rectangular and two lateral sides and back side of the resolution section are all enclosed by the surrounding section.

3. An electroplating anode titanium basket as claimed in claim 1, wherein the surrounding section is made of a panel by bending.

4. An electroplating anode titanium basket as claimed in claim 1, wherein the surrounding section is made of a waved board by bending.

5. An electroplating anode titanium basket as claimed in claim 1, wherein the resolution section and the surrounding section are bent with a curvature.

6. An electroplating anode titanium basket as claimed in claim 1, wherein the metal wires of the resolution section are longitudinally arranged.

7. An electroplating anode titanium basket as claimed in claim 1, wherein the metal wires of the resolution section intersect each other.

* * * * *